United States Patent [19]

Aristone

[11] Patent Number: 4,935,970

[45] Date of Patent: Jun. 26, 1990

[54] CHILD'S POOL

[76] Inventor: Barbara Aristone, 225 Church St., Atco, N.J. 08004

[21] Appl. No.: 336,385

[22] Filed: Apr. 11, 1989

[51] Int. Cl.[5] ..... E04H 3/18

[52] U.S. Cl. ..... 4/488; 4/489; 4/506; D25/2; 272/1 A; 272/71

[58] Field of Search ..... 4/488, 487, 506, 585, 4/496; 52/169.7, 2 H, 2 E, 2 R, 245; 272/71, 1 A; D25/2; D21/252

[56] References Cited

U.S. PATENT DOCUMENTS

| | | | |
|---|---|---|---|
| 1,664,140 | 3/1928 | Tucker | 52/169.7 X |
| 2,505,845 | 5/1950 | Alvarez | 4/585 X |
| 2,529,872 | 11/1950 | Hasselquist | 4/506 |
| 2,842,776 | 7/1958 | Zakin | 4/488 |
| 2,854,049 | 9/1958 | Wyllie | 4/585 X |
| 3,373,450 | 3/1968 | Brooks | 4/488 X |
| 3,454,272 | 7/1969 | Elkington et al. | D21/252 |
| 4,510,632 | 4/1985 | Elsis | 4/506 X |
| 4,642,822 | 2/1987 | Tvengsberg | 4/506 X |
| 4,651,360 | 3/1987 | Wang | 4/506 |

FOREIGN PATENT DOCUMENTS

| | | | |
|---|---|---|---|
| 237228 | 4/1964 | Austria | 4/585 |

*Primary Examiner*—Henry K. Artis

*Attorney, Agent, or Firm*—Norman E. Lehrer

[57] ABSTRACT

A portable child's pool which is suitable for use outdoors is provided having a pool play area suitable for a child to wade or sit in which is surrounded by a second water-retaining unit through which a child user would pass before entering the pool play area, wherein dirt and debris picked up on the feet of the child would be removed.

8 Claims, 2 Drawing Sheets

CHILD'S POOL

FIELD OF THE INVENTION

The present invention relates to a child's play equipment and, more particularly, to a child's portable wading pool having a water-containing unit in which a child could sit or wade while playing surrounded by a water-containing unit of somewhat smaller dimensions through which the child must pass before entering the pool playing unit.

BACKGROUND OF THE INVENTION

There are many types of children's play equipment available for use out-of-doors, such as sandboxes, wading pools, climbing bars, swing sets and the like. They may be readily portable for use anywhere desired, or they may be readily assembled for use in one location but moving to another location would be difficult, or they may require permanent assembly and set up for use in one location.

Generally, play equipment for very young children is preferably readily portable and easily assembled for use in any desired location while being of the type of construction which is sturdy enough to withstand harsh treatment both during use or storage. For example, a child's wading pool, wherein the pool unit is generally large enough for a child to play while sitting or wading in a small amount of water, is of the type that could be easily moved and used on a variety of outdoor surfaces, would be sturdy enough to hold the desired quantity of water and a playing child or children, could be handled and moved, preferably by one adult, and most advantageously, would require only limited storage space.

Typically, a small, tub-like structure or the like fabricated from a self-supporting plastic or thin-wall metal, may be suitable for use as a portable wading pool or play area for a child. Generally, the activity of the child at play includes frequent ingress and egress from the "pool" area which results in rapid fouling of the water. Dirt, grass clippings and other such debris generally present in the area surrounding the "pool" would be picked up on the feet of the child and carried into the water where it would collect. Frequent replacement of the water is generally necessary to limit the amount of such debris and dirt that would accumulate in the area where the child would be playing or sitting. It would thus be desirable if simple means were provided for preventing, or greatly reducing, the accumulation of dirt and other debris in the play area of a child's outdoor play equipment such as a wading pool by cleaning such debris from the child's feet before entering such play area.

SUMMARY OF THE INVENTION

It is an object of the present invention to provide a portable child's wading and sitting pool which includes a water-retaining pool unit for playing, sitting and wading which is readily set up, moved and stored and which includes a device in which the feet of the child user would be cleaned before entering the pool play area.

It is a further object of the present invention to provide a portable child's wading and sitting pool area which when set up on a variety of outdoor surfaces is surrounded by an area suitable for retaining a small portion of water through which a child user would pass before entering the pool play area.

It is a still further object of the present invention to provide a portable child's wading and sitting pool which is light in weight and sturdy and has a water-containing play area and a second, separate water-containing area surrounding the play area through which a child user would pass before entering the water-containing play area.

It is another object of the invention to provide a portable child's wading and sitting pool which is light in weight, sturdy and is adaptable for setting up on outdoor surfaces having a water-containing play area and a second water-containing unit which is adaptable for surrounding the pool play area through which a child user would pass before entering the pool play area during use.

Still another object is to provide a portable child's wading and sitting pool which is collapsible for easy storage and readily inflatable for use.

In accordance with the present invention there is provided a portable child's pool adaptable for setting up on outdoor surfaces comprising a first water-retaining unit of a size suitable for a child's sitting and wading play area and a second water-retaining unit associated with, and preferably surrounding, said first water-retaining unit through which a child user would pass before entering said first water-retaining unit.

In another aspect of the present invention there is provided a portable child's pool comprising a first water-retaining unit suitable for a child's sitting and wading play area having a flat bottom end and at least one circular, preferably inflatable, ring-shaped sidewall sealably secured on one side thereof to the flat bottom end and a second water retaining unit through which a child user would pass before entering said first unit having a flat bottom end extending outwardly from about the flat bottom end of said first water-retaining unit with at least one circular, preferably inflatable, ring-shaped sidewall sealably secured on one side thereof to the outer periphery of said flat bottom end in substantially concentric relationship to the circular ring-shaped side wall of said first water-retaining unit.

The portable child's pool of the present invention may be readily set up for use on a variety of outdoor surfaces and can be conveniently moved to any desired location. When set up for use as a child's wading and sitting play area with the desired amount of water in the play area and in the surrounding water-retaining unit, the water in the surrounding unit serves to clean the feet of the child user before passing to the pool play area. Thus, dirt, clippings and other debris that may be picked up on the feet of the child from the surrounding are would not accumulate in the pool play area thereby reducing the need for frequent cleaning and replacement of the water.

Other objects and advantages of the present invention will become apparent from the detailed description thereof taken in conjunction with the drawings.

BRIEF DESCRIPTION OF THE DRAWINGS

For the purpose of illustrating the invention, there is shown in the accompanying drawings forms which are presently preferred; it being understood that the invention is not intended to be limited to the precise arrangements and instrumentalities shown.

DETAILED DESCRIPTION OF THE INVENTION

The present invention is predicated upon the discovery that portable play equipment for children such as a portable wading pool suitable for use outdoors, when provided with a second water-containing unit surrounding but separate from the water-containing pool play area, through which a child user passes before entering the pool play area affords convenient means for readily cleaning dirt and other debris from the feet of a child user, thus reducing the accumulation of dirt in the play area.

Figure 1:
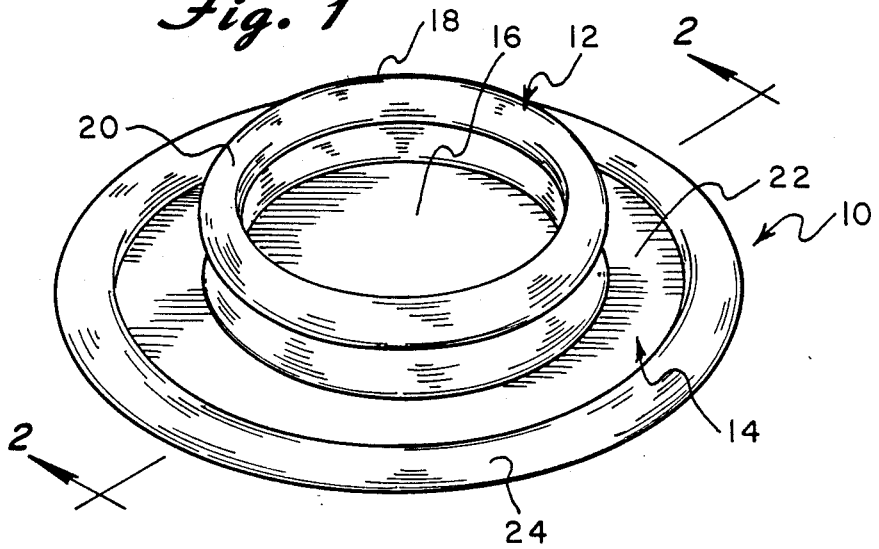
FIG. 1 is a perspective view of a child's pool according to the invention.
Figure 2:
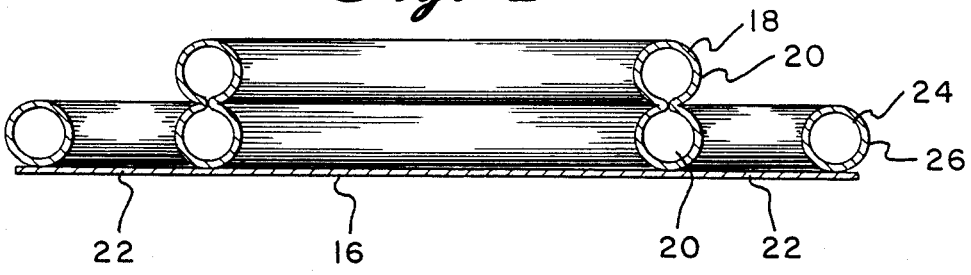
FIG. 2 is a sectional view taken along the line 2—2 of FIG. 1.
Figure 3:
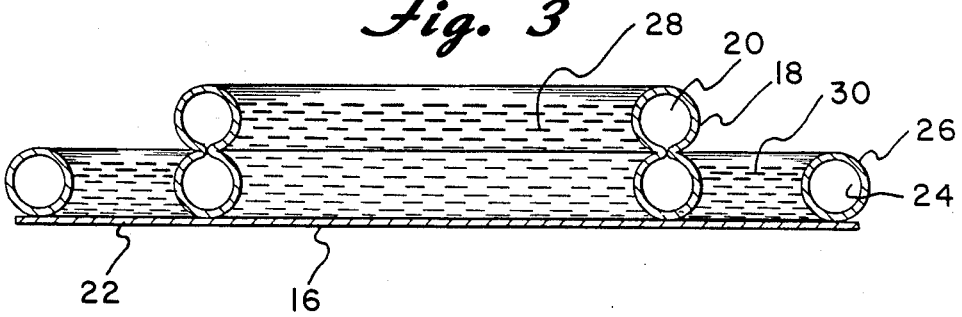
FIG. 3 is a sectional view taken substantially along the line 2—2 of FIG. 1 diagrammatic in its representation of water being present in the pool.

Referring now to the drawings, where like reference numerals identify like parts, there is illustrated in FIGS. 1–3 a portable child's pool, shown generally as 10, in accordance with the present invention. The child's pool 10 of the present invention comprises a wading and sitting pool play area 12 and a second water-containing area 14 which surrounds the pool play area 12 but is separate therefrom.

The pool play area 12 has a bottom end 16 to one surface of which is sealably secured a circular sidewall 18. The bottom end 16 is formed of a sheet of an appropriate plastic material such as polyvinyl chloride which is thick and sturdy enough to support the weight of water desired and one or more children while disposed on a variety of outdoor surfaces, yet is, preferably, sufficiently flexible to permit folding for storage.

The sidewall 18 defining the pool play area 12 is sealably secured by heat-sealing, adhesives or the like to one surface of the bottom end 16 by virtue of which the pool will retain a desired but generally small amount of water 28 in which a child user can wade or sit while playing. The sidewall 18 is formed of two or more continuous tubular rings 20 contiguously sealably secured together to obtain the desired height of the play area. The tubular rings are formed of an appropriate flexible plastic material such as polyvinyl chloride, and can be permanently inflated or, preferably, be inflatable by air or the like when being set up for use.

The second water containing area 14 has a bottom end 22 which is an extension of the sheet of plastic material forming the bottom end 16 of the pool play area 12, and surrounds the play area. Sealably secured by heat-sealing or the like to the surface of the bottom end 22 is a continuous circular tubular ring 24 made from an appropriate flexible plastic material such as polyvinyl chloride. The tubular ring 24 forms a sidewall 26 for the second water-containing unit 14 which is substantially concentric with the sidewall 18, and of a height suitable to retain a small amount of water 30, generally less than that used in the pool play area 12, but which is sufficient to clean the feet of a child user who may be passing through to the pool area. The cross-sectional diameter of tubular ring 24 may be the same or different from that of tubular rings 20 and the ring can be permanently inflated or, preferably, inflatable by air or the like when being set up for use.

The diameter of the concentric sidewall 26 is large enough to form a second water-retaining area 14 which is separate from the pool area within which the foot or feet of a child user can be conveniently placed to clean any dirt or debris therefrom before stepping into the pool play area 12. While the portable pool 10 illustrated in FIGS. 1–3 shows that the pool play area 12 and associated second water-containing area 14 are combined as a single unit having two separate water-retaining areas, the pool play area 12 and second area 14 can be fabricated as separate units which can be assembled for use in the associated relationship shown.

Figure 4:
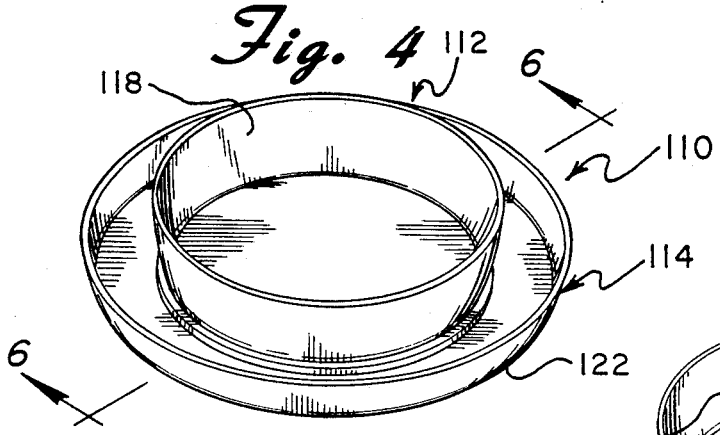
FIG. 4 is a perspective view of an alternate embodiment of a child's pool according to the invention.
Figure 5:
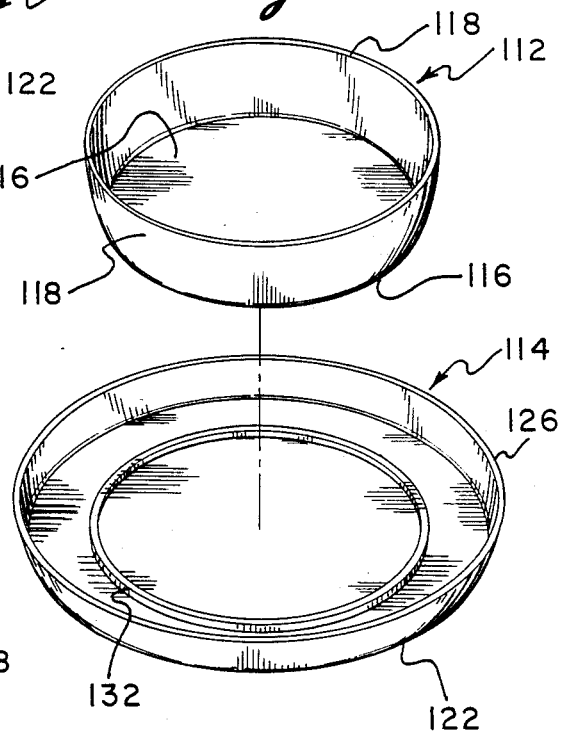
FIG. 5 is a perspective view of the child's pool of FIG. 4 with the first pool playing area unit separated from the second water-containing unit.
Figure 6:
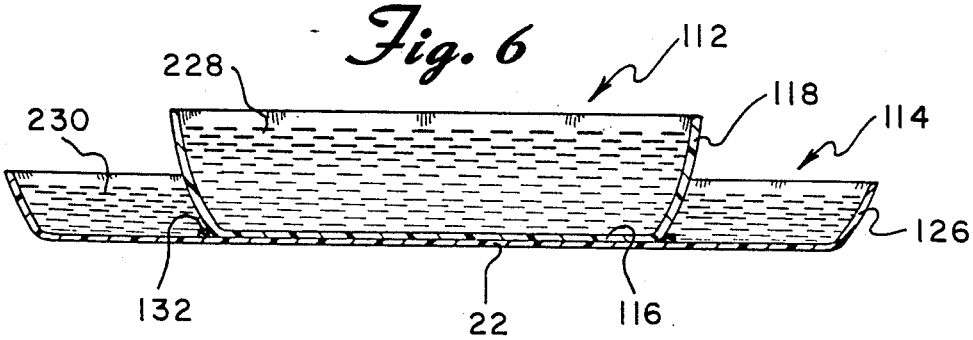
FIG. 6 is a sectional view taken along the line 6—6 of FIG. 4 diagrammatic in its representation of water being present in the play area and surrounding second unit.

In FIGS. 4 to 6 is illustrated an alternate embodiment of the invention wherein the child's pool 110 is combined in a "cup and saucer" type arrangement. The child's pool 110 comprises a wading and sitting pool play area 112 generally in a "cup-like" configuration with a separate "saucer-like" unit 114 combined therewith in a manner which provides a separate water-retaining area 114 surrounding the "pool".

The "cup-like" pool play area 112 has a bottom end 116 and a circular sidewall 118 which can be molded as a water-retaining unit from an appropriate plastic material such as fiber-reinforced plastic (FRP) or the like which is self-supporting and has the strength to support the weight of water and one or more children when used on a variety of outdoor surfaces The separate "saucer-like" water-retaining unit 114 can also be molded as a self-supporting unit from an appropriate material such as fiber-reinforced plastic or the like having a bottom end 122 around the periphery of which extends a sidewall 126. A circular ridge 132 extends inwardly from the bottom end 122 of the "saucer-like" unit to serve as a centering and/or retaining ridge for a "cup-like" pool 112 assembled therewith.

Figure 7:
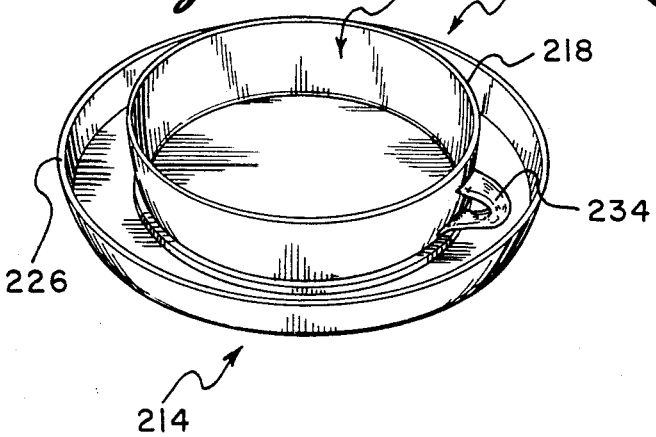
FIG. 7 is a perspective view of another embodiment of a child's pool according to the invention.

In FIG. 7 there is illustrated another embodiment of the child's pool 210 of the invention having a "cup-like" pool play area 212 and a separate "saucer-like" water retaining area 214 wherein a handle 234 is provided for the pool unit 212 so as to more closely resemble a tea cup. It would be evident to one skilled in the art that other known methods or materials can be used for manufacture of the portable child's pool of the invention and that additional child's play equipment such as toy boats, water pistols and the like may be provided in conjunction with the pool play equipment. Moreover, other portable outdoor play equipment for children having a separate water-retaining unit surrounding the play area through which a child user would pass, such as sandboxes and the, like would afford desirable advantages.

Having thus described the invention in relation to the drawings hereof, it will be clear that modifications could be made in the preferred embodiments without departing from the spirit of the invention. Accordingly, it is not intended that the words used to describe the invention be limiting thereof nor should the drawings be considered so. It is intended that the invention be limited only by the scope of the appended claims.

What is claimed is:

1. A portable child's pool comprising a first water-retaining unit of a size and depth sufficient for a child's wading and sitting play area having a substantially flat bottom end and an adjoining circular sidewall and a second water-retaining unit having a substantially flat bottom end connected to and surrounding said flat bottom end of said child's play area and an adjoining circular sidewall spaced from and substantially concentric with the sidewall of said first water-retaining unit, wherein said second water-retaining unit is suitable for retaining a quantity of water between said concentric sidewalls separate from said play area of a shallow depth through which only the feet of a child's user would pass before entering the play area.

2. The portable child's pool according to claim 1, wherein the flat bottom end of said second water-retaining unit is separably connected to the flat bottom end of said first water-retaining unit.

3. The portable child's pool according to claim 1, wherein said first water-retaining unit has an inflatable sidewall.

4. The portable child's pool according to claim 3, wherein the sidewall of said second water-retaining unit is an inflatable sidewall secured on one side thereof to the flat bottom end extending outwardly from and connected to the flat bottom end of said first water-retaining unit which is of a height lower than the height of the sidewall of said first water-retaining unit.

5. The portable child's pool according to claim 4, wherein said inflatable sidewall of said first water-retaining unit is two contiguous circular; continuous inflatable tubular rings sealably secured to the bottom end of said unit and said inflatable sidewall of said second water-retaining unit is one circular, continuous inflatable tubular ring sealably secured to the bottom end of said second unit.

6. The portable child's pool according to claim 2, wherein said second water-retaining unit has a ground contacting bottom end suitable for supporting said pool on a variety of outdoor surfaces with a surface of the bottom end opposite the ground contacting surface thereof having means for centrally locating said first water-retaining unit thereon.

7. Portable play equipment for children comprising a first unit of a size suitable for a child's play area having a substantially flat bottom end and an adjoining sidewall and a second unit surrounding said child's play area having a bottom end separably connected with the bottom end of said first unit and an adjoining sidewall of a height lower than the height of the sidewall of the first unit spaced from and concentric with the sidewall of said first unit, said second unit having means for retaining a quantity of water separate from said play area of a depth sufficient only to clean the feet of a child user before entering the play area, 8. The portable play equipment according to claim 7, wherein said child's play area is a sandbox.

* * * * *